US007004659B1

(12) United States Patent
Goodman

(10) Patent No.: US 7,004,659 B1
(45) Date of Patent: Feb. 28, 2006

(54) METHOD AND APPARATUS FOR DISPENSING SOLUTION ON TOILET PAPER

(76) Inventor: Avery Goodman, 5610 Gatewood La., Greendale, WI (US) 53129

( * ) Notice: Subject to any disclaimer, the term of this patent is extended or adjusted under 35 U.S.C. 154(b) by 193 days.

(21) Appl. No.: 10/705,528

(22) Filed: Nov. 12, 2003

(51) Int. Cl.
*A46B 11/02* (2006.01)
*B05C 11/06* (2006.01)
*B43K 5/00* (2006.01)

(52) U.S. Cl. ..... 401/188 R; 401/266; 401/265; 401/263; 401/205; 401/207; 401/222; 401/633

(58) Field of Classification Search ..... 401/188 R, 401/263–266, 205, 207; 222/633, 565, 321.7
See application file for complete search history.

(56) References Cited

U.S. PATENT DOCUMENTS 4,798,312 A 1/1989 Scheiber
5,435,465 A 7/1995 El-Amin
5,443,084 A 8/1995 Saleur
5,887,759 A 3/1999 Ayigbe
6,457,893 B1 10/2002 Hamilton
6,497,345 B1 12/2002 Wilker et al.
6,592,282 B1 * 7/2003 Fontanet et al. ..... 401/266
6,805,267 B1 * 10/2004 Bougamont ..... 222/633
2003/0049069 A1 3/2003 Osei et al.

* cited by examiner

*Primary Examiner*—David J. Walczak

(57) ABSTRACT

A method and apparatus for dispensing solution on toilet paper includes a container. A pump assembly is adapted for selectively pumping a fluid outwardly out of the container. An actuator panel is attached to a top side of the pump assembly. A fluid receiving housing includes a lower wall, an upper wall and a resiliently collapsible perimeter wall. The upper wall has a plurality of holes extending therethrough. The actuator panel is positioned within the housing and the pump extends downwardly through the bottom wall. The upper wall may be selectively positioned toward the lower wall to actuate the pump such that fluid may be drawn outwardly of the container and into the housing. A coupler attaches the housing to the container. Toilet paper may be positioned on an outer surface of the upper wall such that fluid expelled through the holes is positioned on the toilet paper.

4 Claims, 2 Drawing Sheets

METHOD AND APPARATUS FOR DISPENSING SOLUTION ON TOILET PAPER

BACKGROUND OF THE INVENTION

1. Field of the Invention

The present invention relates to solution dispensing devices and more particularly pertains to a new solution dispensing device for positioning fluid, and more particularly a soap solution, on toilet paper.

2. Description of the Prior Art

The use of solution dispensing devices is known in the prior art. While these devices fulfill their respective, particular objectives and requirements, the need remains for a device that is particularly suited for providing a controlled amount of cleaning solution on a wide area of a section of toilet paper so that the toilet paper is more effective for cleaning.

SUMMARY OF THE INVENTION

The present invention meets the needs presented above by providing a fluid receiving housing having a plurality of holes therein for dispensing fluid on a section of toilet paper. The housing provides controlled dispensing of the fluid across its surface and onto the toilet paper.

To this end, the present invention generally comprises a container having a bottom wall, a top wall and a peripheral wall that is attached to and extends between the top and bottom walls. An opening extends through the top wall and into an interior of the container. A pump assembly is adapted for selectively pumping a fluid outwardly out of the interior. An actuator panel for actuating the pump assembly is attached to a top side of the pump assembly. A fluid receiving housing includes a lower wall, an upper wall and a perimeter wall that extends between and is attached to the lower and upper walls. The upper wall has a plurality of holes extending therethrough. The perimeter wall is resiliently collapsible. The actuator panel is positioned within the housing and the pump extends downwardly through the bottom wall. The upper wall may be selectively positioned toward the lower wall to actuate the pump such that fluid may be drawn outwardly of the container and into the housing. A coupler is attached to the housing for releasably coupling the housing to the container such that the pump assembly extends into the interior of the container. Toilet paper may be positioned on an outer surface of the upper wall such that fluid expelled through the holes is positioned on the toilet paper.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
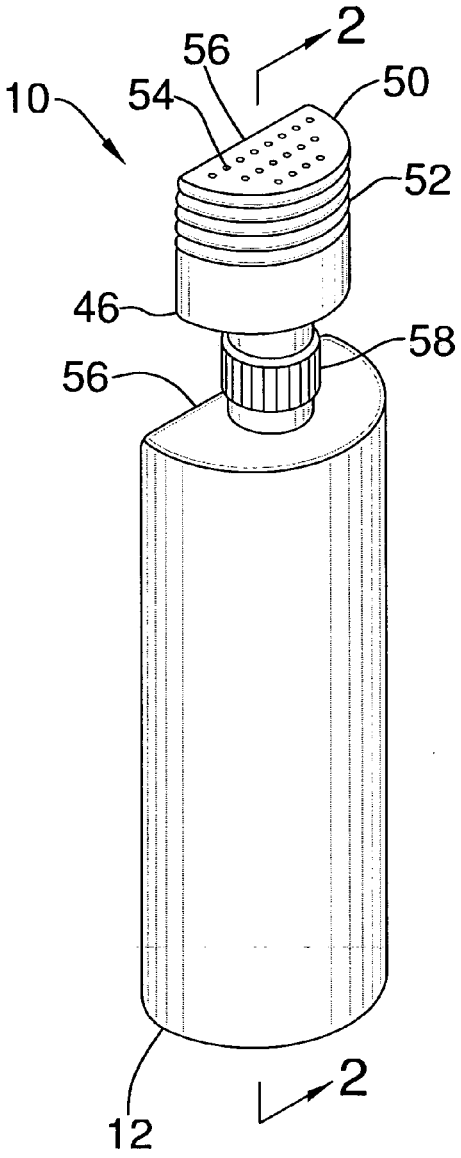
FIG. 1 is a schematic perspective view of a method and apparatus for dispensing solution on toilet paper according to the present invention.
Figure 2:
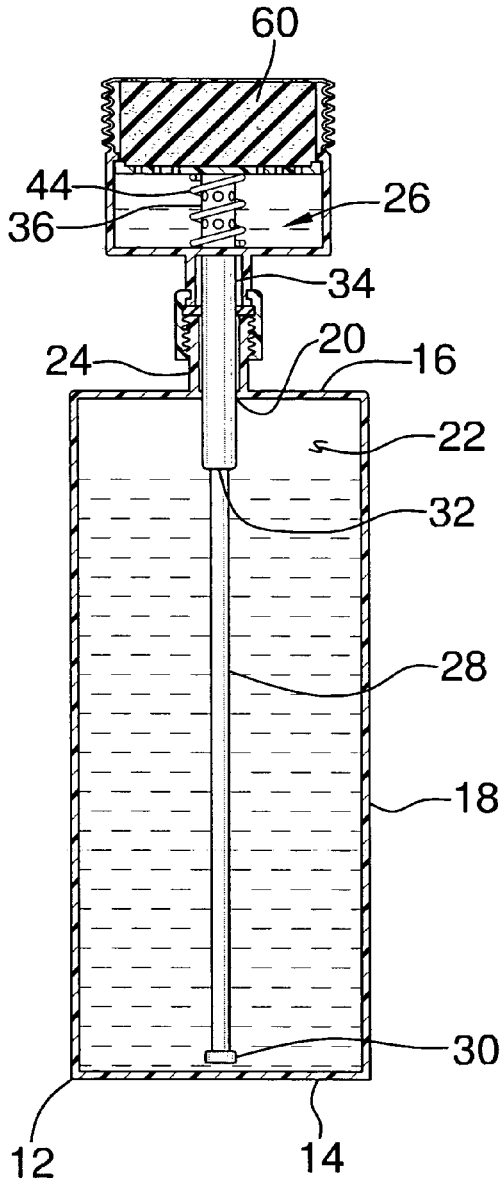
FIG. 2 is a schematic cross-sectional view taken along line 2—2 of FIG. 1 of the present invention.
Figure 3:
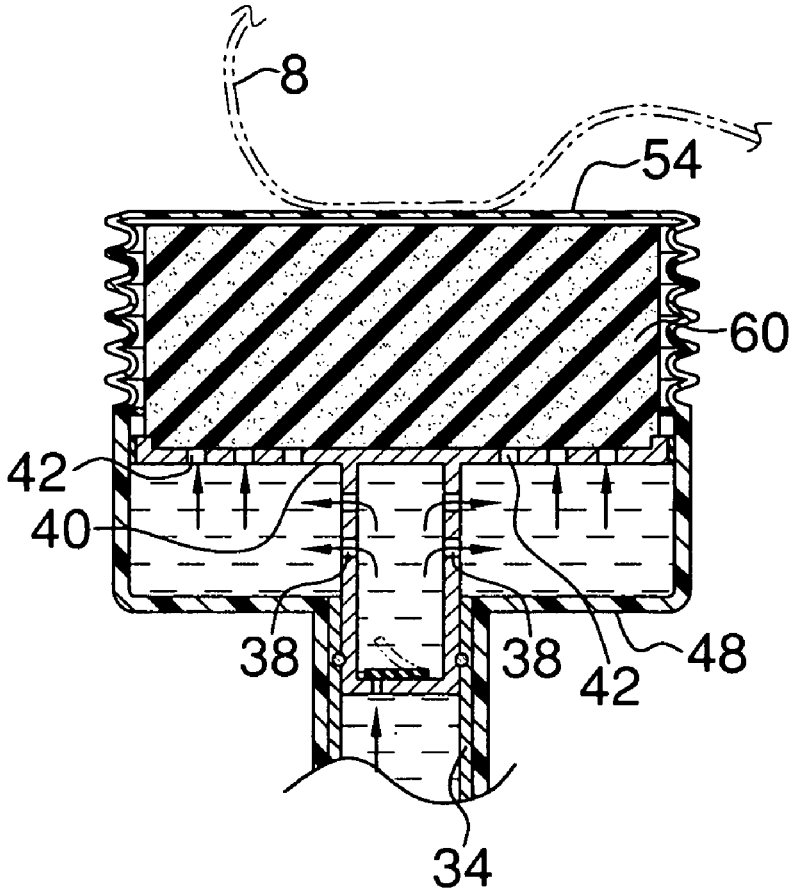
FIG. 3 is a schematic cross-sectional view of the housing of the present invention.

With reference now to the drawings, and in particular to FIGS. 1 through 3 thereof, a new solution dispensing device embodying the principles and concepts of the present invention and generally designated by the reference numeral 10 will be described.

As best illustrated in FIGS. 1 through 3, the method and apparatus 10 for dispensing solution on toilet paper 8 generally comprises a container 12 having a bottom wall 14, a top wall 16 and a peripheral wall 18 that is attached to and extends between the top 16 and bottom 14 walls. An opening 20 extends through the top wall 16 and into an interior 22 of the container 12. Preferably, a threaded neck 24 extends around and upwardly from the opening 20.

A pump assembly 26 is provided for selectively pumping a fluid outwardly out of the interior 22. The pump assembly 26 is a conventional pump assembly and includes a tubular member 28 having lower end 30 and an upper end 32. A pump 34 is attached the upper end 32 for providing suction into said lower end 30. An outlet 36 is fluidly coupled to and extends upwardly from the pump 34. The outlet 36 ideally includes a plurality of outlet apertures 38 extending laterally through said outlet 36.

An actuator panel 40 for actuating the pump assembly is attached to a top side of the outlet 36. The panel 40 is horizontally orientated and has a plurality of apertures 42 extending therethrough. When depressed, the actuator panel 40 actuates the pump 34. A biasing member 44 biases the actuator panel 40 upwards.

A fluid receiving housing 46 includes a lower wall 48, an upper wall 50 and a perimeter wall 52 that extends between and is attached to the lower 48 and upper 50 walls. The upper wall 50 has a plurality of holes 54 extending therethrough. The holes 54 generally cover the upper wall 50. The perimeter wall 52 is resiliently collapsible. The actuator panel 40 is positioned within the housing 46 and the pump 34 extends downwardly through the bottom wall 48. It is preferred that the housing 46 and the container 12 each have a substantially planar vertical side 56 which are orientated co-planar with respect to each other.

A coupler 58 is attached to the housing 46 for releasably coupling the housing 46 to the neck 24 such that the pump 34 assembly extends into the interior 22 of the container 12. The coupler 58 preferably comprises a threaded female coupler for rotatably coupling to the neck 24. In this configuration, the pump assembly 26 extends outwardly through the housing 46, through the neck 24 and into the container 12.

A sponge material 60 is preferably mounted on an upper surface of the panel 40. The sponge 60 absorbs fluid within the housing 46 and expels the fluid through the holes 54 when the perimeter wall 52 is collapsed. The sponge 60 preferably extends from the panel 40 to the upper wall 50 at all times.

In use, collapsing the upper wall 50 toward the lower wall 48 actuates the pump assembly 26. Fluid, preferably a soap and water solution, positioned within the container 12 is drawn outwardly of the container 12 and into the housing 46. The fluid flows through the apertures 42 in the panel 40 and saturates the sponge 60. When needed, a section of toilet paper 8 is positioned against an outer surface of the upper wall 50 such that fluid expelled through the holes 54 is positioned on the toilet paper 8. The housing 46 and sponge 60 provide a more controlled dispensing of the fluid as opposed to the fluid being directly applied to the toilet paper from the pump assembly 26. By pressing down on the upper wall 50, the user may determine the amount of solution dispensed from the housing 46 through the holes 54. When the housing 46 becomes empty, the user fills it again by actuating the pump assembly 26. The toilet paper 8, with the fluid thereon, becomes a more effective cleaning material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning solution application device for selectively positioning cleaning solution on a section of toilet paper, said device comprising:

a container having a bottom wall, a top wall and a peripheral wall being attached to and extending between said top and bottom walls, an opening extending through said top wall and into an interior of said container;

a pump assembly being adapted for selectively pumping a fluid outwardly out of said interior;

an actuator panel for actuating said pump assembly being attached to a top side of said pump assembly;

a fluid receiving housing including a lower wall, an upper wall and a perimeter wall extending between and being attached to said lower and upper walls, said upper wall having a plurality of holes extending therethrough, said perimeter wall being resiliently collapsible, said actuator panel being positioned within said housing and said pump extending downwardly through said bottom wall, wherein said upper wall may be selectively positioned toward said lower wall to actuate said pump such that fluid may be drawn outwardly of said container and into said housing;

a coupler being attached to said housing for releasably coupling said housing to said container such that said pump assembly extends into the interior of said container; and wherein toilet paper may be positioned on an outer surface of said upper wall such that fluid expelled through said holes is positioned on the toilet paper.

2. The device of claim 1, wherein said panel has a plurality of apertures extending therethrough, a sponge material being mounted on an upper surface of said panel, wherein said sponge absorbs fluid within said housing and expels said fluid through said holes when said perimeter wall is collapsed.

3. A cleaning solution application device for selectively positioning cleaning solution on a section of toilet paper, said device comprising:

a container having a bottom wall, a top wall and a peripheral wall being attached to and extending between said top and bottom walls, an opening extending through said top wall and into an interior of said container, a threaded neck being attached to and extending upwardly from a peripheral edge of said opening;

a pump assembly being adapted for selectively pumping a fluid outwardly out of said interior;

an actuator panel for actuating said pump assembly being attached to a top side of said pump assembly, said panel being horizontally orientated, said panel having a plurality of apertures extending therethrough;

a fluid receiving housing including a lower wall, an upper wall and a perimeter wall extending between and being attached to said lower and upper walls, said upper wall having a plurality of holes extending therethrough, said perimeter wall being resiliently collapsible, said actuator panel being positioned within said housing and said pump extending downwardly through said bottom wall, wherein said upper wall may be selectively positioned toward said lower wall to actuate said pump such that fluid may be drawn outwardly of said container and into said housing;

a coupler being attached to said housing for releasably coupling said housing to said neck such that said pump assembly extends into the interior of said container;

a sponge material being mounted on an upper surface of said panel, wherein said sponge absorbs fluid within said housing and expels said fluid through said holes when said perimeter wall is collapsed; and wherein toilet paper may be positioned on an outer surface of said upper wall such that fluid expelled through said holes is positioned on the toilet paper.

4. A method of positioning a cleaning solution on a section of toilet paper comprising the steps of:

providing a container having a bottom wall, a top wall and a peripheral wall being attached to and extending between said top and bottom walls, an opening extending through said top wall and into an interior of said container;

providing a pump assembly being adapted for selectively pumping a fluid outwardly out of said interior;

providing an actuator panel for actuating said pump assembly, said actuator panel being attached to a top side of said outlet, said panel being horizontally orientated, said panel having a plurality of apertures extending therethrough;

providing a fluid receiving housing, said housing including a lower wall, an upper wall and a perimeter wall extending between and being attached to said lower and upper walls, said upper wall having a plurality of holes extending therethrough, said perimeter wall being resiliently collapsible, said actuator panel being positioned within said housing and said pump extending downwardly through said bottom wall;

providing a coupler, said coupler being attached to said housing for releasably coupling said housing to said container such that said pump assembly extends into the interior of said container;

actuating said pump assembly by collapsing said upper wall such that said upper wall is positioned toward said lower wall, wherein fluid positioned within said container is drawn outwardly of said container and into said housing;

providing a sponge material being mounted on an upper surface of said panel, wherein said sponge absorbs fluid within said housing and expels said fluid through said holes when said perimeter wall is collapsed; and positioning a section of toilet paper against an outer surface of said upper wall such that fluid expelled through said holes is positioned on the toilet paper.

* * * * *